US006279786B1

(12) United States Patent
de Pous et al.

(10) Patent No.: US 6,279,786 B1
(45) Date of Patent: Aug. 28, 2001

(54) DEVICE FOR FIXING A DISPENSING MEMBER ON THE NECK OF A CONTAINER

(75) Inventors: Olivier de Pous, Paris; Claude Jouillat, Montigny-sur-Avre, both of (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/308,940

(22) PCT Filed: Nov. 28, 1997

(86) PCT No.: PCT/FR97/02155

§ 371 Date: Sep. 23, 1999

§ 102(e) Date: Sep. 23, 1999

(87) PCT Pub. No.: WO98/23391

PCT Pub. Date: Jun. 4, 1998

(30) Foreign Application Priority Data

Nov. 29, 1996 (FR) ..... 96 14639

(51) Int. Cl.[7] ..... B67D 5/42
(52) U.S. Cl. ..... 222/321.9; 222/385; 222/542
(58) Field of Search ..... 222/321.9, 385, 222/542

(56) References Cited

U.S. PATENT DOCUMENTS 1,264,554 * 4/1918 Peron ..... 222/385 X
2,586,687 * 2/1952 Mellon ..... 222/321.9 X
2,861,839 * 11/1958 Mellon ..... 222/321.9
3,129,854 * 4/1964 Boehm et al. ..... 222/321.9
5,158,211 * 10/1992 Meshberg ..... 222/321.9 X
5,271,532 * 12/1993 Jumel et al. ..... 222/321.9
5,277,340 * 1/1994 Van Brocklin ..... 222/385 X
5,845,819 * 12/1998 De Pous ..... 222/321.9

FOREIGN PATENT DOCUMENTS 2699433 6/1994 (FR) .
WO 95/29760 * 11/1995 (WO) .

* cited by examiner

*Primary Examiner*—Kenneth Bomberg
(74) *Attorney, Agent, or Firm*—Rockey, Milnamow & Katz, Ltd.

(57) ABSTRACT

A device for fixing a dispenser member such as a pump on the neck of a receptacle containing a substance to be dispensed, the device being characterized in that it has a single fixing element made of a deformable material and disposed in the neck of the receptacle between the inside surface of the receptacle neck and the outside surface of the body of the dispenser member, the fixing element being, in the assembled state of the fixing device, deformed and/or compressed by the body of the dispenser member being engaged in the neck of the receptacle in such a manner that it exerts a radial force on the body of the dispenser member and on the neck of the receptacle, the radial force providing reliable and leakproof fixing of the dispenser member to the neck of the receptacle.

16 Claims, 5 Drawing Sheets

DEVICE FOR FIXING A DISPENSING MEMBER ON THE NECK OF A CONTAINER

This application is an application filed under 35 U.S.C. §371 as a national stage of international application PCT/FR97/02155 which has an international filing date of Nov. 28, 1997.

TECHNICAL FIELD

The present invention relates to a device for fixing a dispenser member, such as a pump, on the neck of a receptacle containing a substance to be dispensed. More particularly, the present invention relates to fixing devices for dispensers in which the pump is not fixed to the receptacle by means of an external fixing ring which is snap-fastened or crimped on the neck of the receptacle.

BACKGROUND OF THE INVENTION

Such fixing devices, which are particularly suitable for small-sized dispensers, are known in the state of the art. Thus, for example, document FR-2 719 292 discloses such a device for fixing a metering member in a receptacle containing the substance to be dispensed, in which the pump body is fixed directly in the neck of the receptacle by means of a ferrule which engages inside said pump body, the forced engagement of said ferrule in the pump body establishing a radial force which holds the pump body securely in the neck of the receptacle.

That device which is well adapted to certain dispensers, can turn out to be inadequate or ill-adapted to other types of dispenser.

Thus, in particular, when the same pump body needs to be fixed to receptacle necks of different diameters, the device of document FR-2 719 292 is unsuitable since the outside diameter of the pump body needs to correspond approximately to the inside diameter of the neck of the receptacle. Furthermore, although that device can accommodate manufacturing tolerances both in the neck of the receptacle and in the pump body, such accommodation is limited by the fact of the materials used for the receptacle body (generally glass) and for the pump body (generally a rigid plastics material).

Document FR-2 699 433 discloses an assembly device designed to be easy to assemble and disassemble in a manner similar to a tapering plug. That device has a rigid ring fixed to the pump body and one or more bushes of flexible material for fitting to necks of different diameters. Since the device needs to be easy to disassemble, it does not make it possible to achieve fixing that is reliable and that guarantees perfect sealing.

SUMMARY OF THE INVENTION

An object of the present invention is to provide a fixing device which overcomes the above-specified drawbacks while providing the same advantages, namely low cost for manufacturing and assembling the dispenser. Such low cost is particularly advantageous when the dispenser is used for dispensing a sample that is given away free, such as a sample of perfume.

The present invention also seeks to provide such a fixing device which makes it possible to fit the same dispenser member in receptacles having necks of different diameters.

Another object of the present invention is to provide such a fixing device which is perfectly reliable and leakproof. In particular, the fixing device should not be easy to disassemble.

The present invention thus provides a device for fixing a dispenser member such as a pump on the neck of a receptacle containing a substance to be dispensed, the device being characterized in that it has a single fixing element made of a deformable material and disposed in the neck of the receptacle between the inside surface of said receptacle neck and the outside surface of the body of the dispenser member, said fixing element being, in the assembled state of the fixing device, deformed and/or compressed by the body of the dispenser member being engaged in the neck of the receptacle in such a manner that it exerts a radial force on said body of the dispenser member and on said neck of the receptacle, said radial force providing reliable and leakproof fixing of the dispenser member to the neck of the receptacle.

Preferably, the fixing element is a ferrule whose outside diameter corresponds approximately to the inside diameter of the neck of the receptacle and whose inside diameter is, prior to engagement of the dispenser member, smaller than the outside diameter of the body of the dispenser member.

Advantageously, said fixing element has a radial flange at its top end which rests on the top of the neck of the receptacle, said flange retaining the fixing element while the dispenser member is being engaged.

Preferably, said fixing element has holding means at its bottom end for fixing said fixing element beneath the neck inside the receptacle after the dispenser member has been engaged.

In particular, said holding means comprise one or more swellings of material which, prior to the dispenser member being engaged, project towards the inside of said fixing element and which, during engagement of said dispenser member are forced under the neck of the receptacle by the body of the dispenser member.

Advantageously, the body of the dispenser member has a bottom portion of small diameter which does not act or which acts little on said holding means such that interaction between the dispenser member and said holding means takes place only towards the end of engagement.

In a first embodiment, said holding means are made in the form of tabs, each having a swelling of deformable material at its bottom end.

In a second embodiment, said holding means are made in the form of an annular swelling of deformable material provided at the bottom end of the fixing element.

Advantageously, the body of the dispenser member has an external groove which, in the assembled state of the device after the dispenser member has been engaged, is situated level with said holding means, a portion of said holding means being received in said groove to fix the dispenser member relative to said fixing member.

Advantageously, the fixing element is made of a deformable flexible material such as polyethylene or a thermoplastic elastomer.

BRIEF DESCRIPTION OF THE DRAWINGS

Other characteristics and advantages of the present invention will appear from the following detailed description of various embodiments of the invention given as non-limiting examples and with reference to the accompanying drawings, in which.

DETAILED DESCRIPTION OF THE PREFERRED EMBODIMENT

Figure 1:
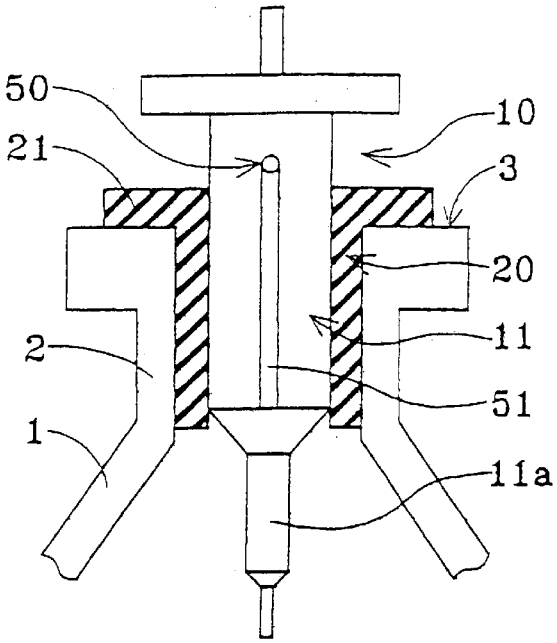
FIG. 1 is a diagrammatic vertical section view through a device of the invention in the semi-assembled state.

With reference to the figures, the invention relates to devices for fixing a dispenser member 10 in the neck 2 of a receptacle 1, e.g. a pump having a body 11. In accordance with the invention, the fixing device comprises a single fixing element 20 made of deformable material which is disposed in the neck 2 of the receptacle 1 between said neck 2 of the receptacle and said pump body 11.

Said fixing element 20 is preferably made of a material that is flexible and deformable such as polyethylene or a thermoplastic elastomer.

Prior to assembly, the fixing element 20 has an outside diameter that corresponds approximately to the inside diameter of the neck 2 of the receptacle, and an inside diameter that is slightly small than the outside diameter of the pump body 11.

According to the invention, when the fixing device is in the assembled state, said fixing element 20 is deformed and/or compressed by the pump body 11 being engaged in the neck 2 of the receptacle so that a radial force is exerted both on said pump body 11 and on said neck 2 of the receptacle, said radial force serving to fix the pump in leakproof manner in the receptacle.

Various variants of the device of the invention are shown in the figures.

Figure 2:
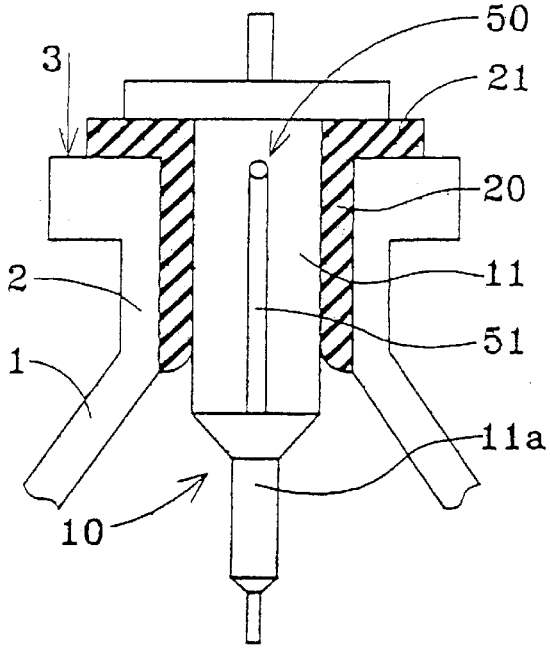
FIG. 2 is a view similar to FIG. 1, showing the device in the assembled state.

Thus, in FIGS. 1 and 2, there can be seen a first variant of the fixing device of the invention. In this variant, the fixing element 20 is made in the form of a cylindrical ferrule which is fitted on and in the cylindrical neck 2 of a receptacle 1, generally made of glass. The cylindrical ferrule 20 advantageously has a radial flange 21 at its top end, i.e. at its end located at the top 3 of the neck 2 of the receptacle 1. Inside the receptacle, the ferrule 20 extends over all or a portion of the height of the neck 2.

The pump body 11 may have a bottom portion of small diameter 11*a* which does not co-operate with said fixing element 20 during engagement. Thus, when the pump 10 is inserted into the neck of the receptacle, the fixing element 20 is advantageously deformed and/or compressed only by the larger diameter portion of the pump body 11, i.e. during a portion only of the engagement process. This deformation and/or compression sets up a radial force which acts on the inside wall of the neck of the receptacle and on the pump body. When the fixing device is in the assembled state, as shown in FIG. 2, the pump 10 is held in place by said radial force exerted by the ferrule 20. The radial flange 21 is of use for holding the ferrule 20 in place on the neck of the receptacle while the pump body is being engaged.

Figure 3:
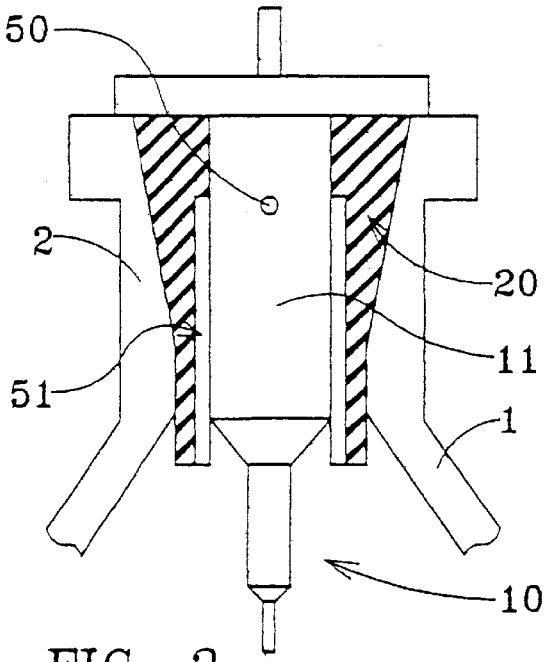
FIG. 3 is a view similar to FIG. 2, showing a variant device of the invention.

With reference to FIG. 3, there is shown another variant of the fixing device of the invention. In this variant, the inside surface of the neck 2 of the receptacle 1 is not cylindrical but is frustoconical, and the fixing element 20 is of complementary shape so that a radial flange as described for the embodiment shown in FIGS. 1 and 2 is not required in this case. Because of the frustoconical inside shape of the neck 2 of the receptacle, the fixing element 20 is automatically held in place in the neck 2 while the pump body 11 is being engaged.

Advantageously, the pump body 11 can have a vent hole 50. The vent hole 50 can be placed in the top portion of the pump body 11 and can be connected to the receptacle via a groove 51 or by any other equivalent means. The groove 51 can be made in the pump body 11 (FIGS. 1 and 2) or in the fixing element 50 (FIG. 3).

Another preferred embodiment is shown in FIGS. 4 to 9. In this embodiment, the fixing element 20 has holding means 25 at its bottom end adapted to fix the fixing element 20 when the device is in the assembled state beneath the neck 2 inside the receptacle 1. As in the example shown with reference to FIGS. 1 and 2, the example shown in FIGS. 4 and 5 has a cylindrical ferrule 20 which fits in a likewise cylindrical neck 2 of the receptacle. Naturally, the embodiment of FIGS. 4 and 5 can also be adapted to the embodiment of FIG. 3 where the inside of the receptacle neck is frustoconical.

Figure 4:
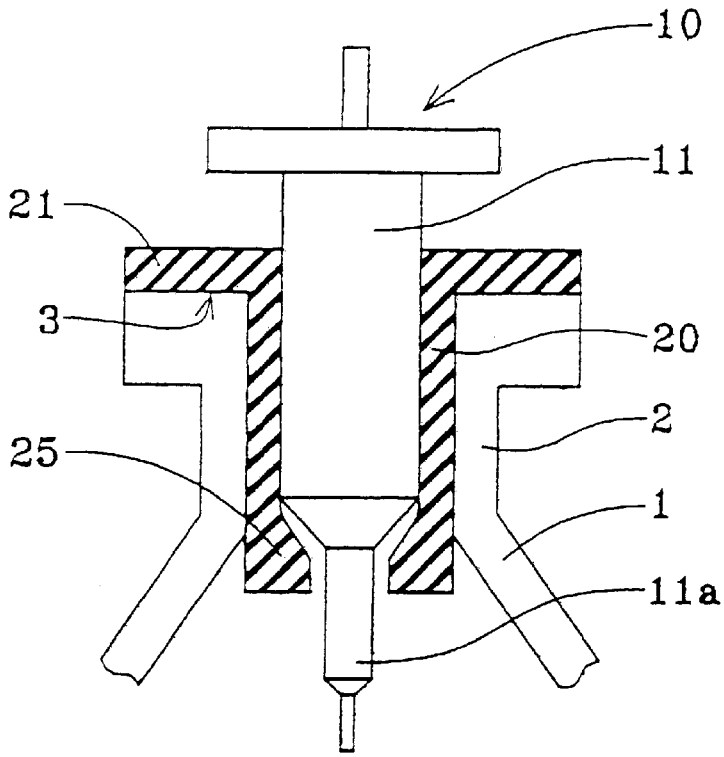
FIG. 4 is a view similar to FIG. 1, showing another embodiment of the invention.
Figure 5:
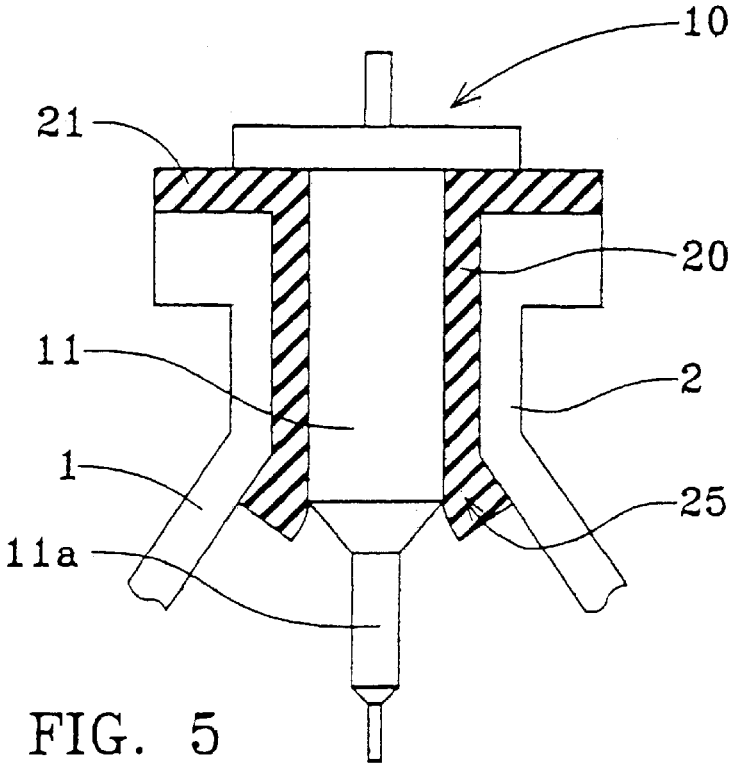
FIG. 5 is a view similar to FIG. 4, in the assembled state.
Figure 6:
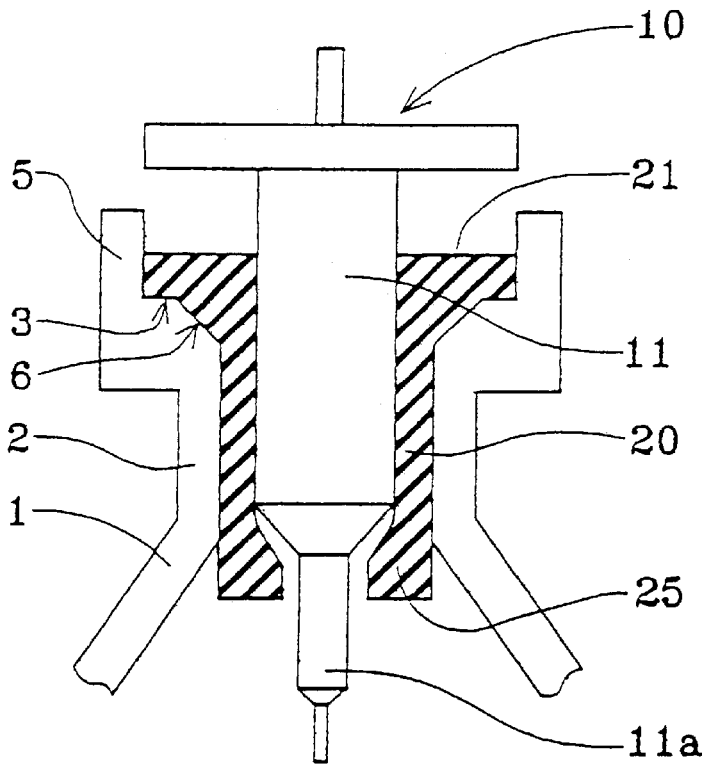
FIGS. 6 to 9 are views similar to FIGS. 4 and 5 showing two variant embodiments of the device shown in FIGS. 4 and 5.
Figure 7:
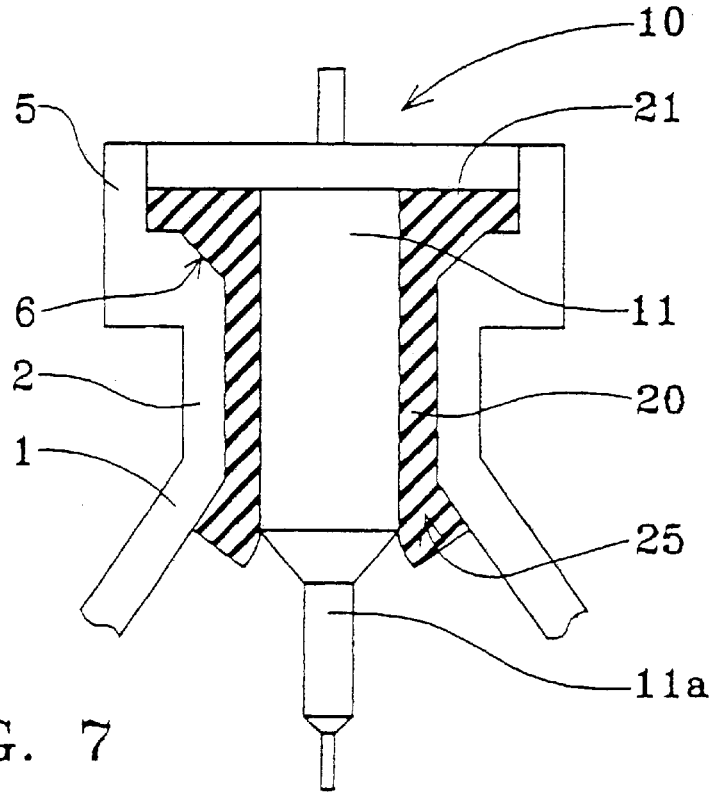

As shown in FIGS. 4 and 5, the holding means 25 comprise one or more thickening of material which, prior to the dispenser member being engaged, i.e. prior to the pump being engaged, project towards the inside of the fixing element 20, and which, during engagement of the pump 10 are forced beneath the neck 2 of the receptacle 1 by the pump body 11, as shown in FIG. 5.

Figure 10:
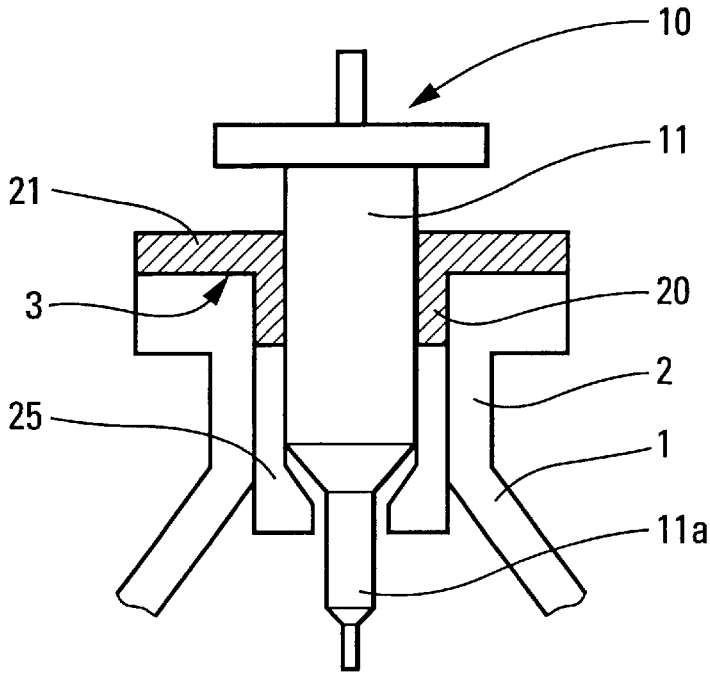
FIGS. 10 and 11 are views similar to FIGS. 4 and 5, respectively, but FIGS. 10 and 11 show two variant embodiments employing holding means in the form of tabs 25*a*.
Figure 11:
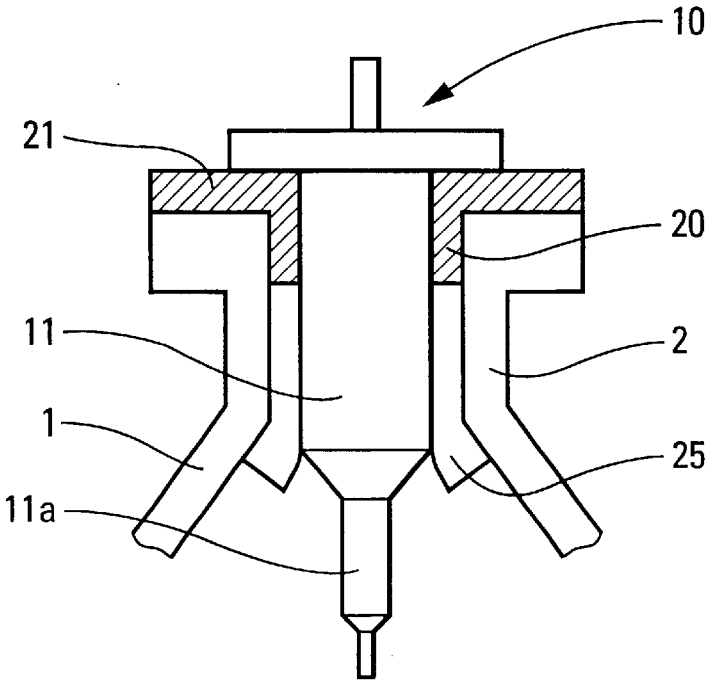

These holding means 25 can be made either in the form of tabs 25*a* (FIGS. 10 and 11) each having a swelling of deformable material at its bottom end, or else in the form of an annular swelling of deformable material provided at the bottom end of the fixing element 20. Advantageously, the pump body 11 has a bottom portion of smaller diameter 11*a* which does not co-operate or which co-operates little with said holding means 25. Thus, material is moved under the neck 2, i.e. the ferrule 20 is fixed beneath said neck, towards the end of the pump body 11 being engaged in the neck of the receptacle.

FIGS. 6 to 9 show a first variant of the device of FIGS. 4 and 5. In this variant, the neck 2 has a peripheral rib 5 designed to receive the flange 21 of the fixing element 20 together with the collar of the pump 10.

Advantageously, the neck 2 also has a frustoconical portion 6 that flares outwards at the top end of the inside surface of the neck 2. This frustoconical portion 6 co-operates with the corresponding portion of the fixing member 20 to provide complete sealing once the pump body 11 has been engaged. The engagement operation has the effect of the fixing element 20 being drawn towards the inside of the neck by the pump body. A high degree of sealing is thus established at the top portion of the device, in particular against the frustoconical portion 6.

Figure 8:
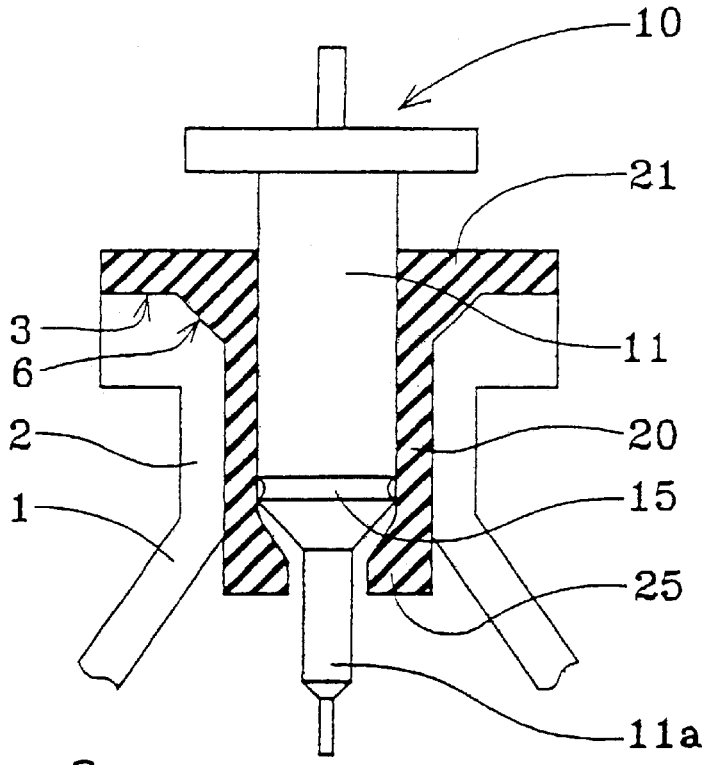
Figure 9:
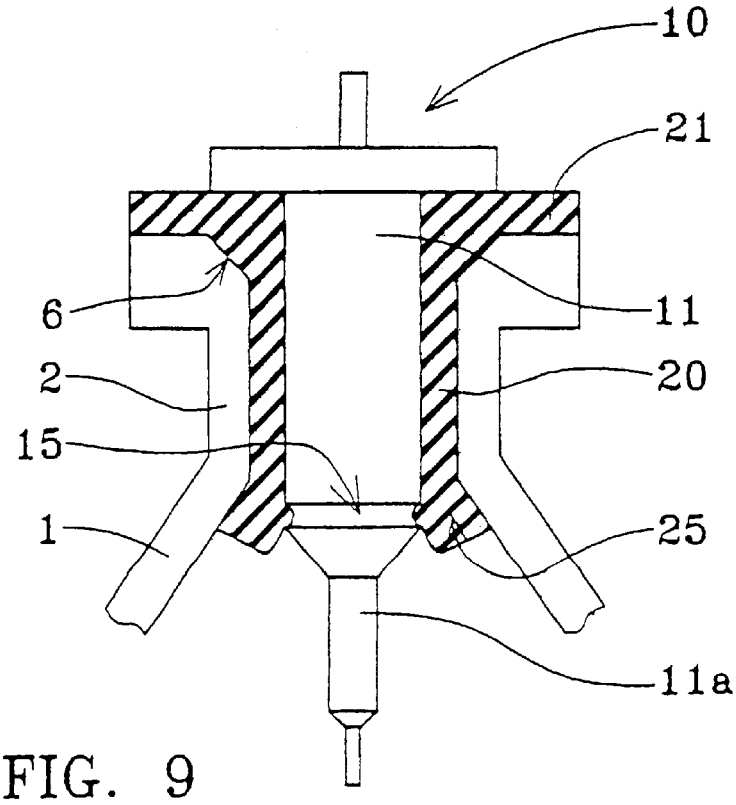

FIGS. 8 and 9 show yet another variant of the device of the FIGS. 4 and 5. In this variant, the pump body 11 has a groove or slot 15, optionally peripheral, which, when the device is in the assembled state, is situated in the neck 20 level with the swellings of material 25. Thus, after the pump body has been engaged, a portion of the swellings of material penetrates into the groove 15, e.g. by creep, so as to fix the pump body relative to the fixing member 20. This makes it practically impossible to disassemble the pump, whereas assembly thereof is made easier.

The fixing device of the present invention presents the following advantages:

1—By using a fixing element 20 of deformable flexible material placed between the neck 2 of the receptacle and the pump body 11, it is possible to fit the same pump body to receptacles 1 having necks 2 of different diameters and/or it is also possible to provide better compensation for manufacturing tolerances concerning the neck of the receptacle and/or the pump body.

2—Forced engagement of the pump body 11 inside the deformable fixing element 20 while the device is being assembled gives rise to deformation of said fixing element 20 in the engagement direction, such that very good sealing occurs at the top end of the fixing element between the neck of the receptacle and the fixing element of the pump body. This applies in particular in the embodiments where the fixing element 20 has a radial flange 21 with a portion thereof being drawn to the inside of the neck 2 of the receptacle while the pump body 11 is being engaged. Sealing is further improved if the neck 2 has a frustoconical top portion 6 as shown in FIGS. 6 to 9. This very good sealing at the top end of the neck of the receptacle makes it possible to provide a connection to the outside atmosphere (not shown) in the pump body 11 inside the neck 2 of the receptacle, this connection being connected to the receptacle, for example, by means of a groove formed in the pump body 11. It is not necessary to put the vent orifice in the small diameter portion 11*a* of the pump body.

3—The presence of the holding means or swellings of material 25 at the bottom end of the fixing element 20 makes it possible, when the device is in the assembled state, to hold the ferrule 20 in non-removable manner inside the neck of the receptacle, so that any disassembly of the device requires the pump body 11 to be extracted by force before it is possible to remove the fixing element 20. This provides very strong fixing of the pump body 11 in the neck 2 of the receptacle 1.

What is claimed is:

1. A combination of components comprising (1) a receptacle containing a substance to be dispersed and having a neck with an inside surface (2) a dispenser member having a body defining an outside surface, and (3) a fixing element wherein the dispenser member is fixed on the neck of the receptacle said fixing element being disposed in the neck of the receptacle between the inside surface of said receptacle neck and the outside surface of the body of the dispenser member, said fixing element being, in the assembled state of the combination of components, deformed and/or compressed by the engagement of the body of the dispenser member in the neck of the receptacle in such a manner that the fixing element exerts a radial force on said body of the dispenser member and on said neck of the receptacle, said fixing element being a single fixing element made of a deformable flexible material, said radial force providing reliable and leakproof fixing of the dispenser member to the neck of the receptacle, said fixing element having a bottom end and holding means at said bottom end for fixing said fixing element beneath said receptacle neck inside the receptacle after the dispenser member has been engaged.

2. The combination according to claim 1, in which the fixing element is a ferrule whose outside diameter corresponds approximately to said inside diameter of the neck of the receptacle and whose inside diameter is, prior to engagement of the dispenser member, smaller than an outside diameter of the body of the dispenser member.

3. The combination according to claim 1 or 2 in which said neck has a top, and in which said fixing element has a top end and a radial flange at said top end which rests on said top of the neck of the receptacle, said radial flange retaining said fixing element while said dispenser member is being engaged.

4. The combination according to claim 3, in which the fixing element is made of a deformable flexible material being either polyethylene or a thermoplastic elastomer.

5. The combination according to claim 2, in which the fixing element is made of a deformable flexible material being either polyethylene or a thermoplastic elastomer.

6. The combination according to claim 1, in which said holding means comprise one or more swellings of material which, prior to the dispenser member being engaged, project toward the inside of said fixing element and which, during engagement of said dispenser member are forced under the neck of the receptacle by the body of the dispenser member.

7. The combination according to claim 6, in which the fixing element is made of a deformable flexible material being either polyethylene or a thermoplastic elastomer.

8. The combination according to claim 1, in which the body of the dispenser member has a bottom portion of small diameter such that interaction between the dispenser member and said holding means takes place only towards the end of engagement.

9. The combination according to claim 8, in which the fixing element is made of a deformable flexible material being either polyethylene or a thermoplastic elastomer.

10. The combination according to claim 1, in which said holding means are made in the form of an annular swelling of deformable material provided at the bottom end of the fixing element.

11. The combination according to claim 10, in which the fixing element is made of a deformable flexible material being either polyethylene or a thermoplastic elastomer.

12. The combination according to claim 1 in which the fixing element is made of a deformable flexible material being either polyethylene or a thermoplastic elastomer.

13. A combination of components comprising (1) a receptacle containing a substance to be dispensed and having a neck with an inside surface, (2) a dispenser member having a body defining an outside surface, and (3) a fixing element wherein the dispenser member is fixed on said receptacle neck, said fixing element being disposed in said receptacle neck between said inside surface of said receptacle neck and said outside surface of said dispenser member body, said fixing element being, in the assembled state of the combination of components, deformed and/or compressed by the engagement of said dispenser member body in said receptacle neck in such a manner that said fixing element exerts a radial force on said dispenser member body and on said receptacle neck, said fixing element being a single fixing element made of a deformable flexible material, said radial force providing reliable and leakproof fixing of said dispenser member to said receptacle neck, said fixing element having a bottom end and holding means at said bottom end for fixing said fixing element beneath said receptacle neck inside said receptacle after said dispenser member has been engaged, and said holding means being made in the form of tabs, each tab having a swelling of deformable material at its bottom end.

14. The combination according to claim 13, in which the fixing element is made of a deformable flexible material being either polyethylene or a thermoplastic elastomer.

15. A combination of components comprising (1) a receptacle containing a substance to be dispensed and having a neck with an inside surface, (2) a dispenser member having a body defining an outside surface, and (3) a fixing element wherein the dispenser member is fixed on said receptacle neck, said fixing element being disposed in said receptacle neck between said inside surface of said receptacle neck and said outside surface of said body of said dispenser member, said fixing element being, in the assembled state of the combination of components, deformed and/or compressed by the engagement of said dispenser member body in said receptacle neck in such a manner that said fixing element exerts a radial force on said dispenser member body and on said receptacle neck, said fixing element being a single fixing element made of a deformable flexible material, said radial force providing reliable and leakproof fixing of said dispenser member to said receptacle neck, said fixing element having a bottom end and holding means at said bottom end for fixing said fixing element beneath said receptacle neck inside said receptacle after said dispenser member has been engaged, said holding means comprising one or more swellings of material which, prior to said dispenser member being engaged, project towards the inside of said fixing element and which, during engagement of said dispenser member, are forced under said reciptacle neck by the body of said dispenser member, and said body of the dispenser member having an external groove which, in the assembled state of the components after the dispenser member has been engaged, is situated level with said holding means, a portion of said holding means being received in said groove to fix the dispenser member relative to said fixing element.

16. The combination according to claim 15, in which the fixing element is made of a deformable flexible material being either polyethylene or a thermoplastic elastomer.

* * * * *